United States Patent [19]

Saxton

[11] Patent Number: 4,472,837

[45] Date of Patent: Sep. 25, 1984

[54] HEAD COVERING FOR RETAINING ARTICLES

[76] Inventor: Ronald P. Saxton, 5019 N. High St., Box 103, Columbus, Ohio 43214

[21] Appl. No.: 548,941

[22] Filed: Nov. 7, 1983

[51] Int. Cl.[3] ..... A42B 1/24

[52] U.S. Cl. ..... 2/199; 2/171.4; 2/195; 2/209.1

[58] Field of Search ..... 2/196, 199, 171.1, 171.4, 2/171.5, 171.6, 171.7, 171.8, 185 R, 175, 179, 180, 171.2, 422, 10

[56] References Cited

U.S. PATENT DOCUMENTS 1,603,422 10/1926 Sloan ..... 2/185 R

*Primary Examiner*—Werner H. Schroeder
*Assistant Examiner*—J. L. Kravitz
*Attorney, Agent, or Firm*—Robert B. Watkins

[57] ABSTRACT

A head covering containing a carrier means for securely retaining an article. The carrier means may be affixed or removably attached to a crown means or some other portion of the head covering. A flap or cover means may be present to cover and protect the carrier means and the article to be retained.

4 Claims, 4 Drawing Figures

FIG. 1
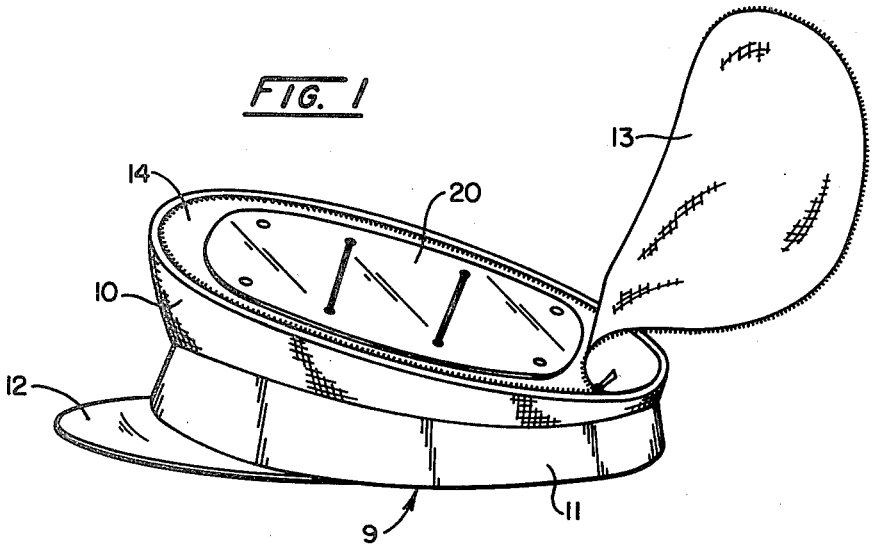
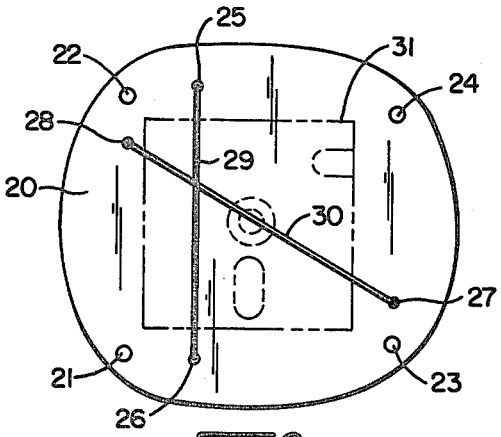
FIG. 2
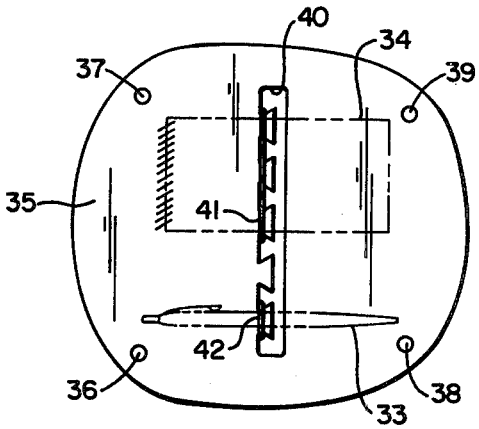
FIG. 3
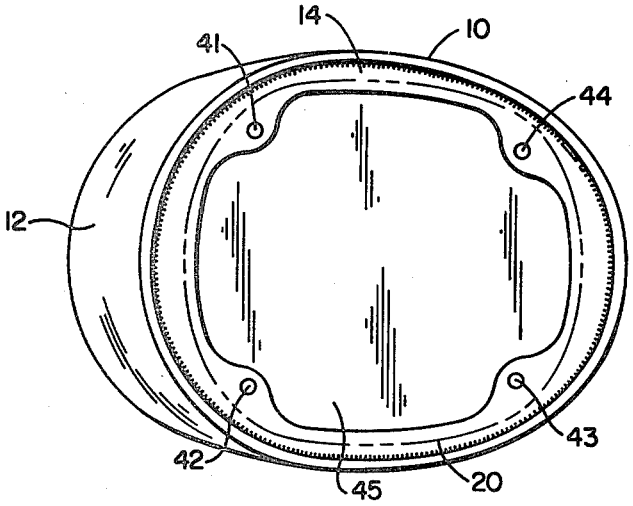
FIG. 4

HEAD COVERING FOR RETAINING ARTICLES

FIELD OF THE INVENTION

This invention relates to head coverings. More specifically, it relates to head coverings suitable for retaining articles.

BACKGROUND OF THE INVENTION

Headcoverings, and specifically hats, are primarily used to provide protection for the head against the elements and serve to compliment the fashion of the wearer's apparel.

Headcoverings in the prior art have frequently been designed to serve a secondary function. The secondary function frequently gives the hat unique characteristics that serve a specific need. This may cause a head covering to have more appeal as a novelty item or to direct its usefulness towards a specific market.

An early example of a hat that serves a secondary function is illustrated in U.S. Pat. No. 1,422,435—Gooding. In this invention, a hat that was stylish in its day had a pocket with a flap that snapped closed within the crown of the cap. The pocket was just large enough to carry a small article, such as a key, placed within it. In this particular instance, a secondary function performed by the pocket did not add to the style of the cap or appeal to a particular novelty interest of a potential market.

A second example of a hat with a secondary function is illustrated in U.S. Pat. No. 1,869,652—Baker. In this invention zippers were placed on the top of the crown portion of a hat. These zippers opened up into a pocket formed within the lining of the hat in which items could be stored. The patent discloses a secondary usefulness of the hat as being for storage of fishing items, such as hooks, bobs, and flys. The secondary function of this hat is particularly aimed at a specific market, that being for fishermen, and has claims directed to the existence of a compartment within the crown as well as the usefulness of this compartment for fisherman.

More recently, patents dealing with head coverings that serve a secondary function have been directed to the casual or sportswear markets. Examples are U.S. Pat. No. 4,312,076—Gamm and U.S. Pat. No. 4,386,437—Fosher. In both these examples head coverings which could be generically described as ball caps are disclosed in which pockets or compartments are formed by some means within the lining of the cap. In Gamm the frontal portion of the crown has a segment of cloth partially sewn on the crown to form a pocket with the upper portion of the cloth serving as a flap that is held down by Velcro® or a snap. Small items can be stored within this portion of the crown. In Fosher a compartment is formed in the same location of the crown as disclosed in Gamm, but access to this interior pocket is by a different means. The fashioning of the materials in Fosher to form the interior pocket yields a more rigid fontal portion of the cap and access is achieved through the bottom of the cap in the hat band area.

All of the above inventions serve in one manner or another to use a hat for the secondary function of storing small articles. Once these articles are stored, they are free to move about within the storage area of the hat, thus shifting the hat's center of gravity and causing it to be more likely to move about on the wearer's head or fall off his head altogether. Larger bulkier articles can cause protrusions into the hat and make the hat uncomfortable to wear. None of these head coverings are designed to securely retain the articles that are carried or prevent the movement of the articles within the pockets of the head covering.

SUMMARY OF THE INVENTION

The present invention is a head covering comprising a receptacle portion constructed to hold and support a carrier means that retains an article.

The preferred embodiment of the present invention is a head covering comprising a crown means and/or band for support of the head covering on a head of a wearer. A separable flap means is attached to the crown means and is fully or partially removable to uncover a receptacle portion of the head covering. A carrier means is fixed on or insertable in the receptacle portion and is constructed to hold and support an article within the receptacle portion.

The present invention has a carrier means or retainer card for holding small articles within a pocket or some other portion of a head covering. The retainer card securely holds articles and keeps them from moving about within the cap. The carrier or retainer card may have different shapes and designs suitable for various articles. When a retainer card is used, it inserts into the head covering and is itself held within the receptacle portion of the crown. The retainer card may be removable from the head covering so that articles can be more easily inserted therein. When the carrier means is made of a hard, rigid material, it prevents secured articles from protruding into the head covering and causing discomfort for the wearer.

Articles specifically suited for being retained on the carrier means of this invention are items such as floppy disks for computers, small cassettes, or even note pads with pencils. This is because these articles are flat and function best when they have not been creased or bent. A generally rigid carrier means will support these articles and protect them from such damage. The retainer card of this invention may even be molded so as to have recessed portions in which specific items may fit or even snap into place. The retainer card of this invention may also have grooves or knotches about which elastic band members or similar materials may hold an item in place. Instead of notches, string or elastic bands may be wrapped through holes within the retainer card and then tied.

An object of this invention is to provide a head covering in which articles may be carried and securely retained in place.

Another object of this invention is to provide a protective means for carrying floppy discs and small computer related articles within a head covering.

Other features and objects of the invention will be apparent from the following drawings and description, as well as the appended claims.

BRIEF DESCRIPTION OF THE DRAWINGS

FIG. 1 is a perspective view of a head covering in which a carrier means is inserted in a receptacle portion that may be covered by a flap means.

FIG. 2 is a plan view of an embodiment of a carrier means for use in this invention with a phantom view of a computer floppy disk shown being retained.

FIG. 3 is a plan view of an alternative embodiment of a carrier means with a phantom view of a note pad and pen shown being retained.

FIG. 4 is a top plan view of an embodiment of the receptacle portion within the crown of a head covering with a phantom view of a carrier means inserted in place.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION OF THE INVENTION

Referring to FIG. 1, head coverings 9 are generally constructed of three major components. The first component is a crown means 10 or covering. This portion provides the cover over the head of a wearer. It may be fashioned from many materials depending upon the style and function of the head covering to be constructed. In some head coverings, for example, a skullcap, this will be the only component present. In head coverings such as an accountant's visor, this component will be absent. This first component may be made of flexible material or even steel as with a helmet.

The second component found in most head coverings is the band 11. It is generally at the lower perimeter of the crown means 10 and serves to hold the head covering snugly on the head of the wearer. This component is often adjustable. Occasionally the band only serves a decorative function.

The last major component found on head coverings is the bill 12. A bill 12 may partially or completely extend around the perimeter of a head covering. It is generally, when present, attached at the base of the crown means 10 or head band 11 of a head covering 9 and usually extends outward from the head covering 9. The bill 12 may serve to protect the wearer from exposure to the sun or elements, or it may be completely decorative.

FIG. 1 illustrates a head covering 9 of this invention. The embodiment of this head covering 9 is in the style of a Greek fisherman's cap. In this embodiment, the head covering consists of a crown means 10 with an encircling ridge portion, a head band 11, and a bill 12. On the upper portion of the crown means 10 there is a separable flap 13 which may be partially or completely removable. The flap 13 may be removably affixed to the crown means 10 by any suitable means including a zipper 15 or a hook and pile fastening means (not shown) such as Velcro®, a registered trademark of the National Velcro Company of New York, New York. Around the upper perimeter of the crown means 10 is a receptacle portion 14. A carrier means, such as a retainer card 20, attaches onto the receptacle portion 14. In this manner the retainer card 20 is securely held within the crown means 10 of the head covering 9. The flap 13 may then be laid over of the crown means 10 enclosing the retainer card 20 and preventing the retainer card 20 and the articles held upon it from being exposed to dust or from being lost. When the flap 13 is secured about its perimeter, the head covering 9 retains a normal fashionable appearance.

The components and elements of this invention may change in style, shape, and size where retainer cards of different sizes are utilized. When larger retainer cards 20 are utilized, a larger crown means 10 will be required. When this is the case, alternative embodiments may utilize different styles of bills or may vary the size of the head band to change the external appearance of the head covering 9. For example, a wider head band 11 may be used in head coverings where a large retainer card 20 is stored in the crown means 10. In this manner the appearance of the head covering will be less "military-like" and the wider band will make the large upper portion of the crown less awkward in appearance. Where smaller retainer cards 20 are utilized, their positioning on a receptacle portion 14 may be moved about the head covering 9 to other locations including a surface of the bill 12. For example, a very small retainer card would be suitable for the frontal area of the crown portion 10 of a head covering. Additionally, in the alternatively embodiments the placement of the flap may be externally located on the crown or formed by the lining of a head covering 9.

This invention when used in embodiments suitable for military head coverings or head coverings as traditionally worn by policemen, could accommodate a much larger retainer card. Therefore, items, such as note pads with accompanying pens, could be securely retained in the larger crowns of this style of head covering.

FIG. 2 illustrates the preferred embodiment of a carrier means or retainer card 20 holding a computer floppy disk 31. About the perimeter of this embodiment, are snap receiving holes 21, 22, 23, and 24 which are located for attachment to the receptacle portion 14 as illustrated above. On the retainer card 20 retainer holes 25, 26, 27, and 28 are located such that elastic band members 29 and 30 may be passed through them. It would also be suitable for the purposes of this invention to replace the retainer holes 25, 26, 27, and 28 with notches on the outside edge of the retainer card 20. In this manner the elastic band members 29 and 30 may be stretched about the edges of the retainer card 20 and held in place by the notches on the retainer card's edge. The elastic band members 29 and 30 of this embodiment may be replaced by nonelastic members such as cord or string. However, to accommodate a variety of articles, the use of an elastic material to construct these bands is more suitable for the purposes of the invention. The placement of the retainer holes 25, 26, 27, and 28 for the elastic band members 29 and 30 should be as near the perimeter of the retainer card 20 as possible when only a small number of such holes are to be present. This will allow for larger articles to be retained by the elastic band members 29 and 30. It is possible, however, where the retainer card 20 is designed to hold a note pad and a pencil to have a greater number of holes for retaining a greater number of elastic band members on the retainer card. Where a notebook pad was to be held on a retainer card adjacent to a pen, the placement of the holes and the elastic band members would be side by side and would not have to be located near the retainer card's outer perimeter. The embodiment illustrated in FIG. 2 is more universal for retaining a greater variety of articles than is the retainer card described for holding specific items as a notebook pad with accompanying pen.

Retainer cards may also have retainer holes located across their length and width. When no specific item is to be carried by a retainer card, construction of the card from a perforated material is useful. A perforated material will yield the greatest amount of adaptability for the use of the retainer card. When retainer cards with a plurality of retainer holes are used, elastic band members or string-like members that have free ends can be passed through the selected retainer holes and then fastened or tied together. Other attachment means, such as clips fashioned in the retainer card or rivetted thereon, can be provided separately or compliment the string-like member.

FIG. 3 illustrates an alternative embodiment of a retainer card 35 holding a note pad 34 and a pen 33. On this retainer card 35, snap receiving holes 36, 37, 38 and 39 are present to accommodate the receptacle portion 14. As shown in FIG. 2, these holes accommodate a snap means or a hook means within the receptacle portion 14 for holding the retainer cards 20 or 35 securely in place. Other methods, such as the use of Velcro® material, may be suitable for holding retainer cards on the receptacle portion 14 within the crown means 10 of a head covering.

FIG. 3 further illustrates a notched portion 40 cut into the body of the retainer card 35. This notched portion 40 has a plurality of jagged edges forming notches of a dovetail shape, about which an elastic band member 41, such as that described in FIG. 2, can be stretched. In this embodiment articles of various widths are easily accommodated and securely held in place by stretching the elastic band members 41 and 42 about the articles and the number of notches required to hold those articles in place. In this manner, wider articles will have the elastic band members 41 or 42 stretched across a greater number of notches, whereas narrower articles, such as pens, may have an elastic band member stretched over one or two notches. In FIG. 3 only one notched portion 40 is illustrated. However, a plurality of such notched portions can be placed on a single card. The width of the notches themselves can vary between different notched portions within a single retainer card 35. In this manner a greater variety of widths of articles can be securely held by elastic band members. Also with a plurality of notched portions similar to notched portion 40, present on a single receptacle card 35, more than one location is available to secure a single article held by the retainer card 35.

Retainer cards such as those pictured in FIGS. 2 and 3 may be made of a variety of materials including cardboard or plastic. Where only general use is contemplated for retaining a variety of articles, the material used is not critical to the invention. However, when the specific use of a retainer card is contemplated, such as to hold a floppy disk for a computer game or a computer program, the material chosen is more critical.

Computer related articles such as floppy disks or cassettes are made of materials that can be magnetically influenced. The information on these computer related articles can become lost or confused if the article is exposed to static electricity. When computer related articles are exposed to dust, oily films, or dirt the related equipment into which these articles are placed will become fouled and will fail to properly function. When computer related articles are to be carried by this invention, the material chosen for the retainer card construction should be such that the retainer card maintains a stiff, rigid position to protect the computer related article and prevent its becoming folded or bent. Also, the material chosen should be one that does not attract static electricity, such as cotton or leather or some kind of plastic materials.

The material chosen to fashion the crown means of the head covering is not generally critical for use in this invention when general articles are to be retained. However, when computer related articles, such as a computer floppy disk, are to be retained, the material must again not be one that attracts static electricity and should be tightly woven so as to keep dust and foreign matter from penetrating into the receptacle portion of the crown.

An alternative of this invention also includes constructing a carrier means out of material such as a sheet of plastic or cloth formed as an envelope with a zipper or some other closure. This envelope could be held in place by the receptacle portion located within the crown of the head covering. In this manner the carrier means need not be a stiff retainer card but could be made of a flexible material and yet would still securely hold articles within a certain portion of a head covering.

Still another alternative of this invention, though less suitable for many other uses, is to permanently fix a retainer card within the lining or crown means of a head covering which is specifically fashioned to hold a particular article. For example, a retainer card forming approximately a five and a quarter inch or eight inch square could be fashioned in the lining of a head covering. The material of the head covering could be fashioned around the retainer card to form a flap of approximately the same size and shape and large enough to enclose the article to be carried. This embodiment is suited for carrying a five and a quarter inch or eight inch floppy computer disk. In this manner the article to be retained is still held securely and the retainer card provides adequate support about the surface area of the disk to support it and keep it from becoming bent. In such an embodiment the retainer card still acts as a carrier means for a particular article and is designed to protect that article. Retainer holes can still be present in a permanently affixed retainer card to accommodate string or elastic band members as described above. Though this embodiment of the invention would work well for head coverings that are designed to attract a specific market, such as those desiring to carry computer related articles, it is less adaptive for general purposes than would be the embodiments pictured in FIG. 2 or FIG. 3.

When any of the embodiments of this invention are constructed to carry a specific article within a head covering, so that the head covering is directed at a specific market, a novelty value is provided while serving its secondary function.

FIG. 4 illustrates the preferred embodiment of the receptacle portion 14 located within the crown 10 of a head covering. This embodiment shows the flap 13 completely removed. In this illustration the receptacle portion 14 is specifically designed to accommodate retainer cards 20 and 35 as illustrated in FIGS. 2 or 3. The retainer portion 14 has snap positions 41, 42, 43 and 44 located in positions corresponding to the snap receiving holes 21, 22, 23, and 24 of the retainer card 20 of FIG. 2 or the snap receiving holes 36, 37, 38 and 39 of the retainer card of FIG. 3. As discussed above, other means for affixing or attaching a retainer card or carrier means within the receptacle portion 14 may be suitable such as the use of a Velcro® material. Placement of the retainer portion 14 above a floor or an inner head lining 45 will prevent oils and perspiration on the wearer's head from entering the compartment enclosing the retainer card and article to be carried. In this manner items, such as floppy disks for computers, are protected. The shape of the retainer portion 14 may add to the style of the particular head covering chosen. Therefore, when square items, such as computer floppy disk containers, are to be carried, a rounded receptacle portion 14 will prevent the style of the head covering from being adversely affected by the square shape of the article to be retained.

The material of the retainer portion 14 may be of a rigid material, such as plastic, or a flexible material depending upon the style and purpose of the head covering. In certain embodiments the retainer portion 14 of the head covering may not be a solid circular piece as illustrated in FIG. 4. An alternative embodiment could have a receptacle portion of a hat made with a plurality of wire-like appendages extending upward from the head band of a cap. In still another embodiment where the carrier means is permanently fixed to the crown means, the crown means itself also acts as a receptacle portion.

It is herein understood that although the present invention has been specifically disclosed with the preferred embodiments and examples, modification and variations of the concepts herein disclosed may be resorted to by those skilled in the art. Such modifications and variations are considered to be within the scope of the invention and the appended claims.

What is claimed is:

1. A head covering comprising:

a. a receptacle portion constructed to hold and support a carrier means that retains an article; and b. a separable flap means attached to the head covering, removable to uncover the receptacle portion of the head covering.

2. A head covering according to claim 1 wherein the separable flap means closes over the receptacle portion with a zipper.

3. A head covering according to claim 1 further comprising:

c. a crown means for support of the head covering on the head of a wearer.

4. A head covering according to claim 3 wherein the crown means is an encircling ridge portion, the receptacle portion is formed juxtaposed to a flap fastenable to the crown member, and the crown member has a floor within.

* * * * *